US006590147B2

(12) United States Patent
Kassabian

(10) Patent No.: US 6,590,147 B2
(45) Date of Patent: Jul. 8, 2003

(54) BASS DRUM PEDAL

(76) Inventor: Todd Michael Kassabian, 1719 N. Umberland Way, Bldg. 1, South Brunswick, NJ (US) 08852

( * ) Notice: Subject to any disclaimer, the term of this patent is extended or adjusted under 35 U.S.C. 154(b) by 0 days.

(21) Appl. No.: 09/850,631

(22) Filed: May 4, 2001

(65) Prior Publication Data

US 2002/0056357 A1 May 16, 2002

Related U.S. Application Data

(60) Provisional application No. 60/248,321, filed on Nov. 14, 2000.

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS

| | | | | |
|---|---|---|---|---|
| 2,027,869 A | * | 1/1936 | Londe | 84/422.1 |
| 2,845,830 A | | 8/1958 | Haviland | |
| 3,742,806 A | | 7/1973 | Zalmer | |
| 3,747,464 A | | 7/1973 | Russell | |
| 4,782,733 A | * | 11/1988 | Herring | 84/422.1 |
| 5,627,332 A | | 5/1997 | Lombardi | |
| 5,990,401 A | | 11/1999 | Braun et al. | |
| 6,137,040 A | | 10/2000 | Hoshino | |

* cited by examiner

*Primary Examiner*—Shih-yung Hsieh
(74) *Attorney, Agent, or Firm*—William W. Haefliger

(57) ABSTRACT

A bass drum pedal includes a spool-like hub carrying a beater stem; a foot actuated foot board that is pivotally mounted; and a flexible connector directly interconnecting the foot board and the hub. A tension spring biasing rotation of the hub has an end portion swivel connected to a pedestal carrying the hub.

43 Claims, 18 Drawing Sheets

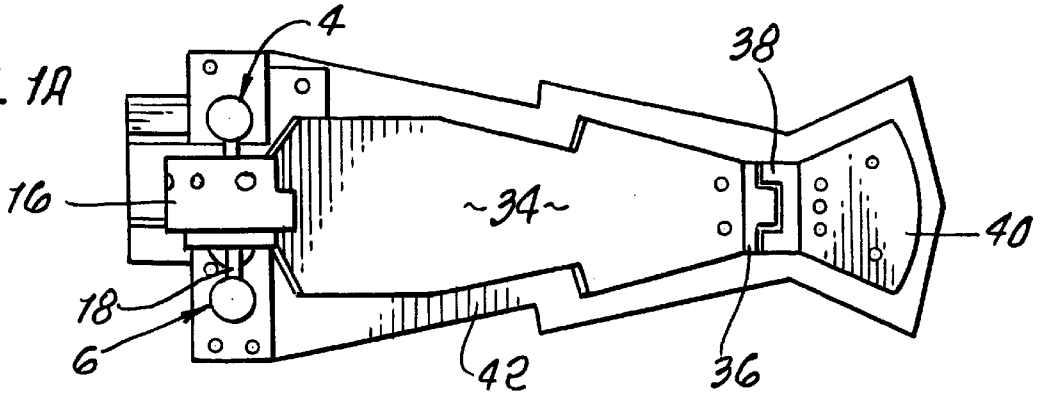
FIG 1.1A
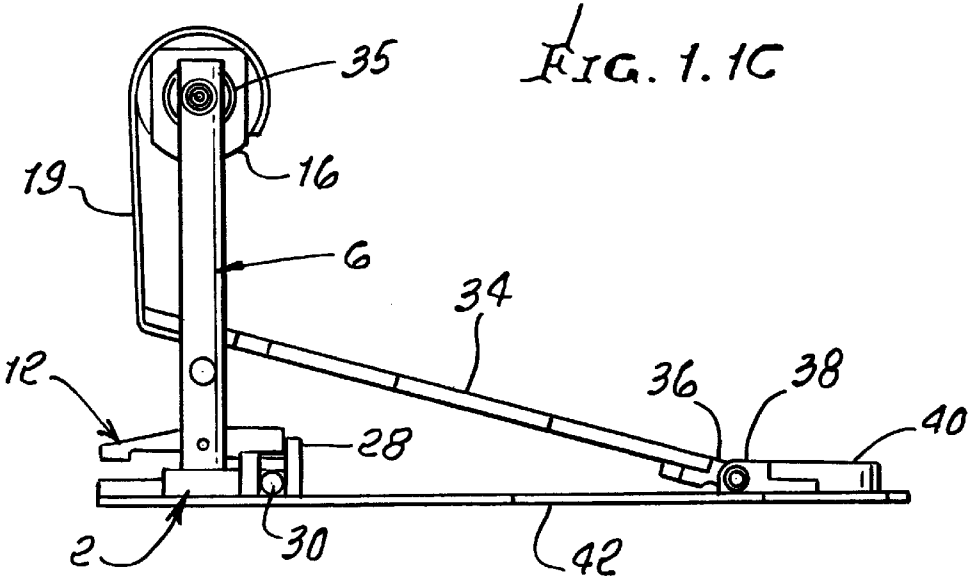
FIG. 1.1C
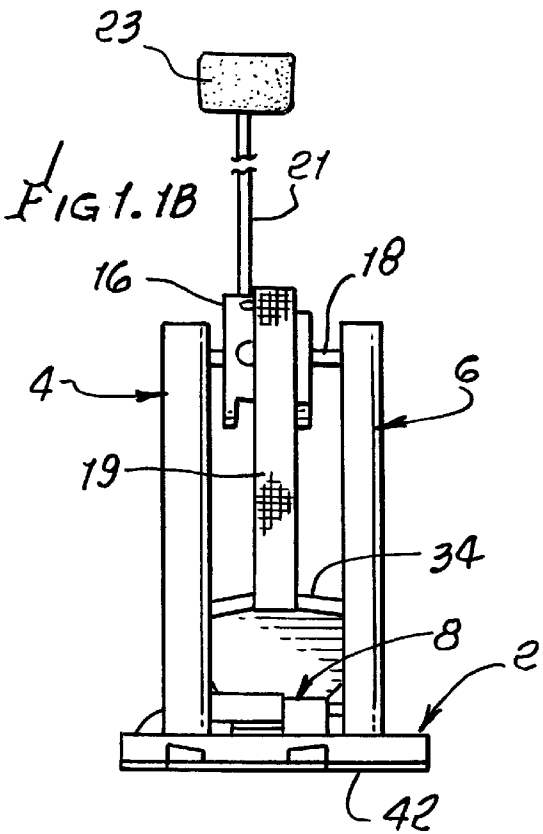
FIG 1.1B

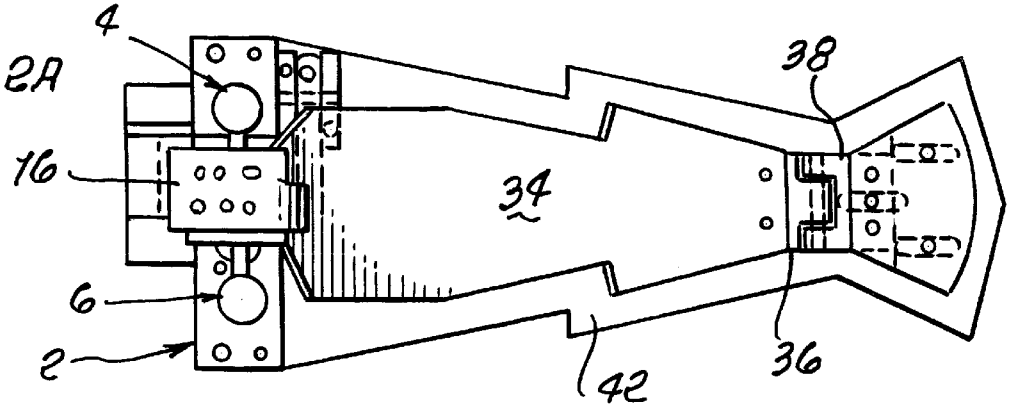
FIG. 1.2A
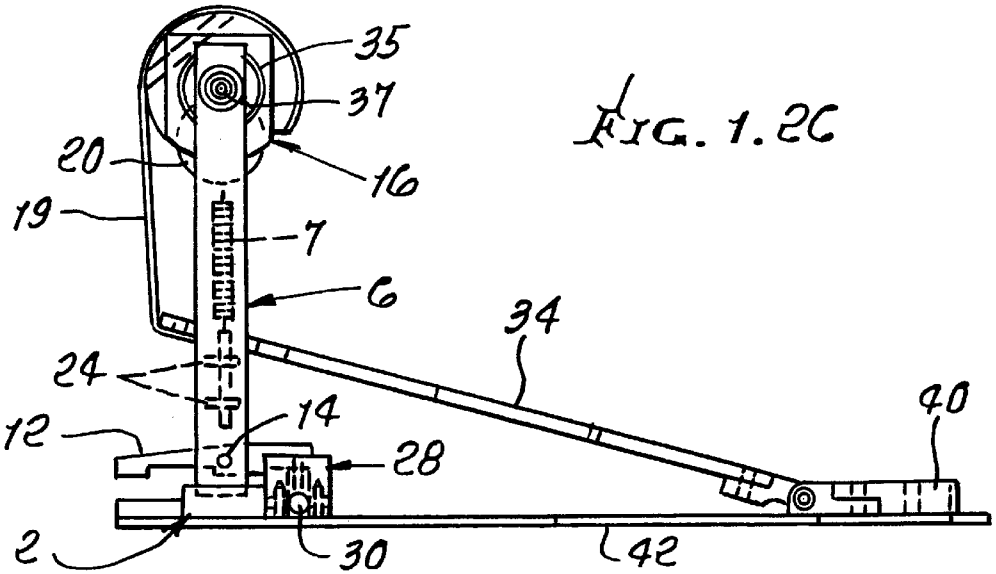
FIG. 1.2C
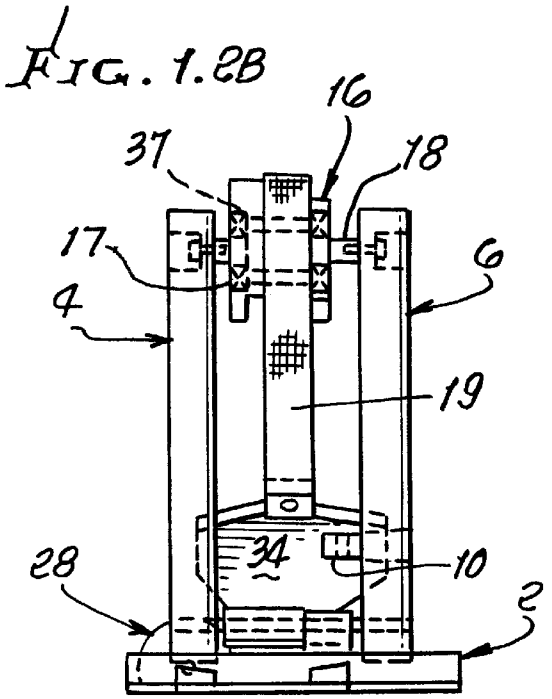
FIG. 1.2B

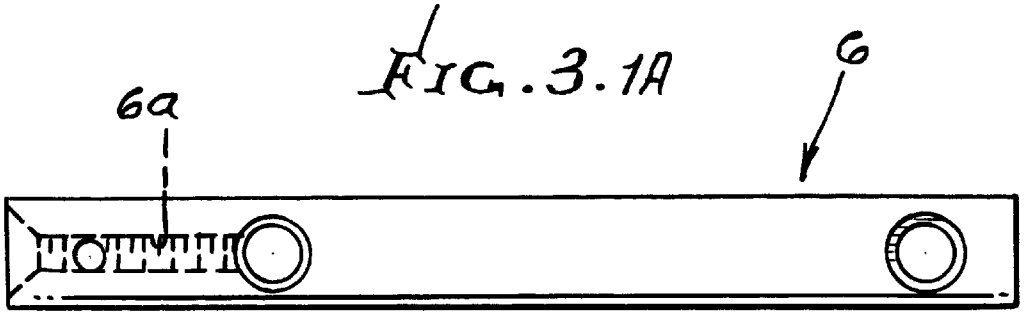
FIG. 3.1A
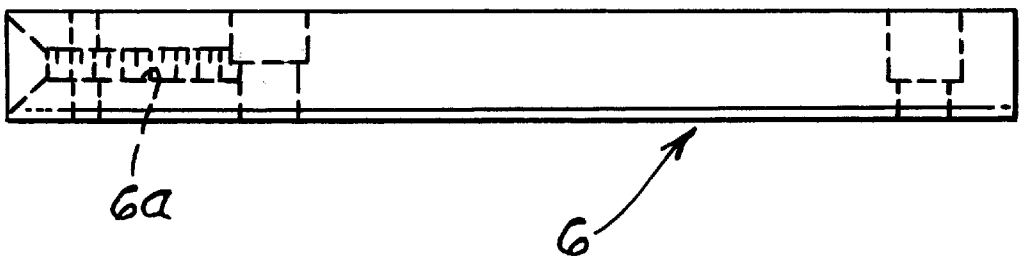
FIG. 3.1B
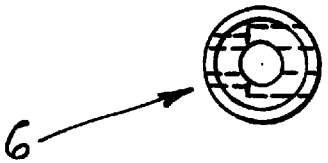
FIG. 3.1C

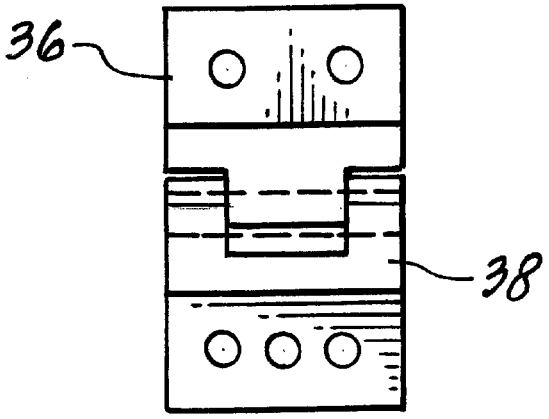
FIG. 20E.
FIG. 21A.
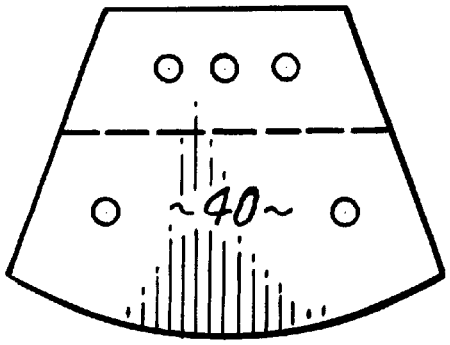
FIG. 21B.
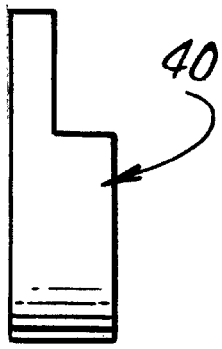

BASS DRUM PEDAL

This application claims priority over U.S. provisional application Serial No. 60/248,321 filed Nov. 14, 2000.

BACKGROUND OF THE INVENTION

The field of the invention relates generally to drum pedals, and more particularly to substantially frictionless drum pedals.

Drummers rely upon drum pedals for striking a bass drum. In order to facilitate the playing of a bass drum, it is important that the drum pedals have good overall performance, including adequate response and reaction time. Over the years, drum pedals have been under continuous development, for improving the response of the pedals, the reaction time, and the overall feel of the drum pedal to the drummer himself, for maximizing the performance of the drummer in playing bass drums. The present inventor recognized that it is important to minimize the frictional engagement of the moving parts of a drum pedal, in order to enhance or improve the performance of the drum pedal.

SUMMARY OF THE INVENTION

It is a major object of the invention to provide an apparatus and method to achieve improvements as referred to, and as are disclosed herein. Basically the invention is embodied in an improved drum pedal unit having:

a) a base plate, b) a foot board having first and second ends, c) a hinge connected between the base plate and a first end of said foot board for permitting rotation thereof, d) first and second rod-like towers or pedestals, each mounted at one end, respectively, to the base plate, with their other respective ends being free, e) a shaft mounted to project between the opposing upper portions of the first and second towers.

In such a pedal unit, the invention provides:

f) a spool-like hub mounted for axial rotation on a central portion of the shaft, whereby said hub can rotate independent of rotation of the shaft, and if during such rotation the hub at some point frictionally engages said shaft, said shaft rotates with said hub, g) rotating means including a flexible connector connected between a second end of the foot board and an outer portion of the hub, for causing the hub to rotate relative to the foot board upon depression of the foot board, h) a beater stem having a first end secured to an outer portion of the hub, and a second end, i) a beater secured to the second end of said beater stem, and j) spring means for spring biasing the hub in a rest position of the bass drum pedal, for retaining the second end of the foot board in an elevated position relative to the base plate, and the beater a predetermined distance away from a drum head of an associated drum, whereby upon depression of the foot board the second end thereof is rotated toward the base plate causing the rotating means to rotate the hub in a direction for moving said beater into contact with the drum head of the associated drum.

Additional objects include: provision of a second tower spaced from the one tower, the spring means located between the towers; provision of the spring means in the form of a tension spring having one end thereof pivotally connected to the hub; provision of a pivotal connection between the opposite end of the spring and one of the towers; provision of the flexible connector in the form of a belt having one end portion wrapping partially about said hub; provision of a ball bearing unit mounting the hub for rotation on the axle; provision of a pivotal connection between the hub and the tower, whereby the spring has said one end thereof pivotally connected to the hub; and wherein the flexible connector defines an upright plane, the spring pivotal connection located at one side of that plane, and said beater stem located at the opposite side of that plane.

These and other objects and advantages of the invention, as well as the details of an illustrative embodiment, will be more fully understood from the following specification and drawings, in which:

BRIEF DESCRIPTION OF THE DRAWINGS

FIGS. 1.1A, 1.1B, and 1.1C are a top plan view, partial back elevational view, and left side elevational view, respectively of portions of one embodiment of the present invention;

FIGS. 1.2A, 1.2B, and 1.2C are a bottom plan view, back elevational view, and left side elevational view with a left tower removed, respectively, for portions of the invention also seen FIGS. 1.1A, 1.1B, and 1.1C;

FIG. 3.1A shows a side elevational view of a left tower of the present invention;

FIG. 3.1B shows a side elevational view of the left tower of FIG. 3.1A rotated 90°;

FIG. 3.1C shows a bottom plan view of the left tower of FIG. 3.1A;

FIG. 1OA is a front elevational view of a spring return wheel of the present invention, the backside being identical thereto;

FIG. 20E is a plan view of the assembly of the hinge parts of FIGS. 18A and 20C;

FIG. 21A is a top plan view of a heel pad of the present invention;

FIG. 21B is a side elevational view of the heel pad of FIG. 21A, with the opposite side being a mirror image thereof;

DETAILED DESCRIPTION OF THE INVENTION

Figure 2A:
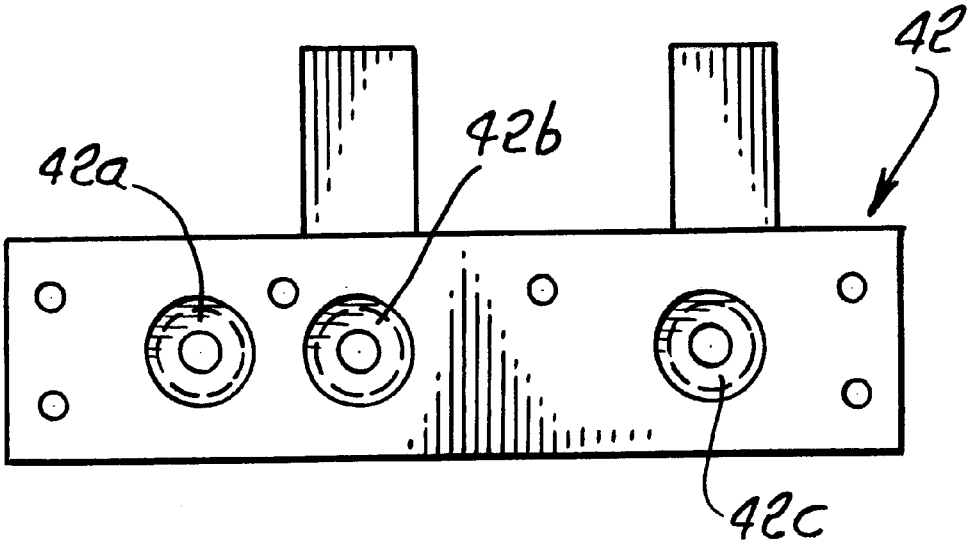
FIG. 2A shows a top plan view of a tower base plate of the present invention.
Figure 2B:
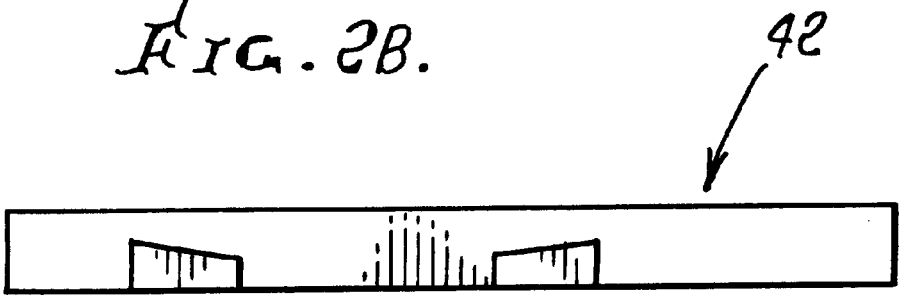
FIG. 2B shows a front elevational view of the tower base plate of FIG. 2A.
Figure 3A:
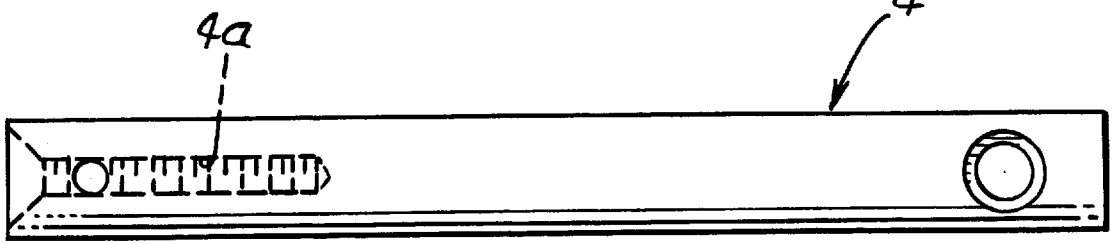
FIG. 3A shows a side elevational view of a right tower.
Figure 3B:
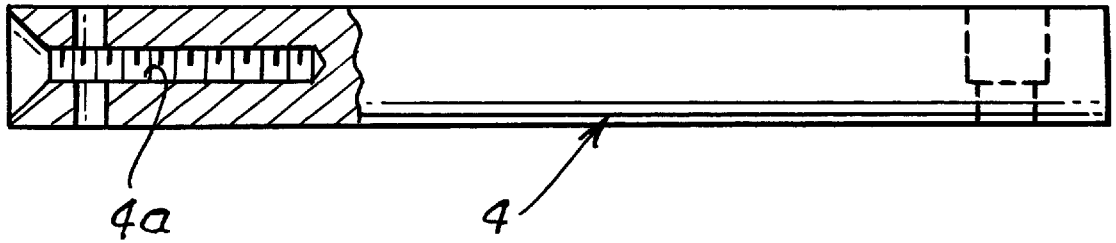
FIG. 3B shows a side elevational view of the right tower of FIG. 3A, rotated 90°.
Figure 3C:
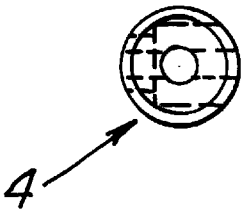
FIG. 3C shows a bottom plan view of the right tower 4 of FIG. 3A.
Figure 4A:
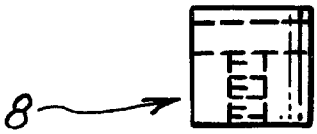
FIG. 4A shows a front elevational view of a lever lock hinge tower of the present invention.
Figure 4B:
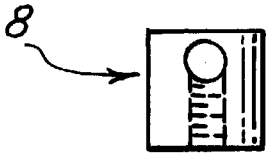
FIG. 4B shows a side elevational view of the level lock hinge tower of FIG. 4A.
Figure 4C:
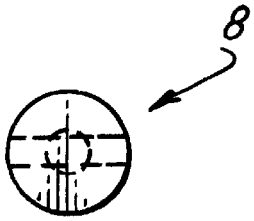
FIG. 4C shows a top plan view of the level lock hinge tower of FIG. 4A.
Figure 5:
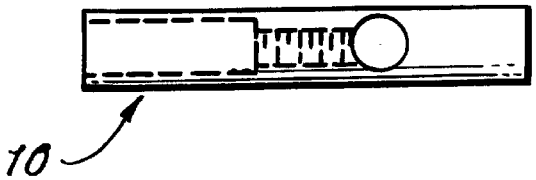
FIG. 5 shows a top plan view of a tower spring return bearing stem of the present invention.
Figure 6A:
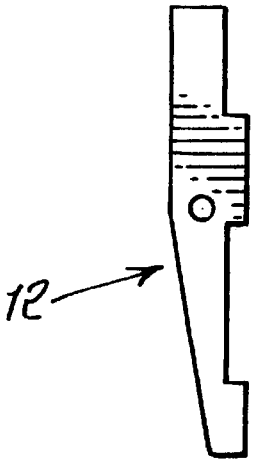
FIG. 6A shows a side elevational view of a lock tab of the present invention.
Figure 6B:
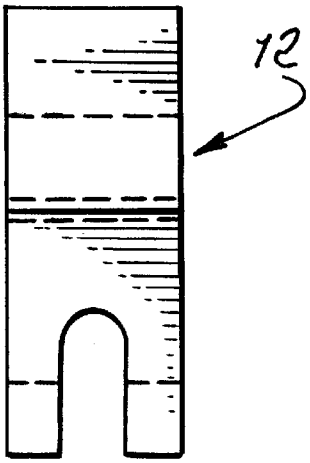
FIG. 6B shows a top plan view of the lock tab of FIG. 6A.
Figure 7A:
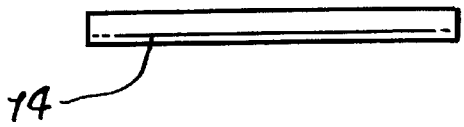
FIG. 7A shows a side elevational view of a lever lock hinge pin of the present invention.
Figure 7B:
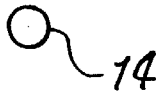
FIG. 7B shows a top plan view of the lever lock hinge pin of FIG. 7A.
Figure 8A:
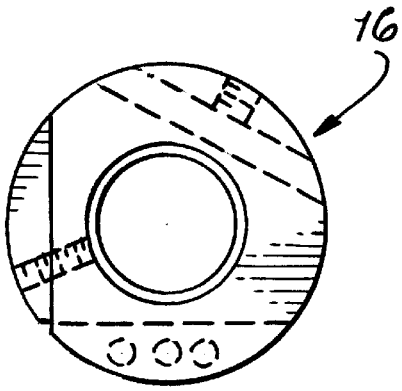
FIG. 8A is a right side elevational view of a hub of one embodiment of the invention.
Figure 8C:
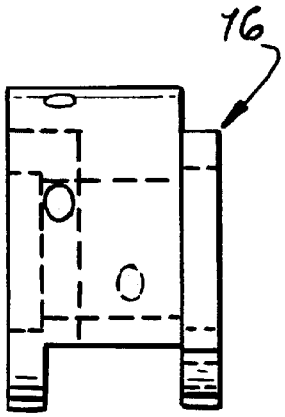
FIG. 8C is a back elevational view of the hub of FIG. 8A.
Figure 8B:
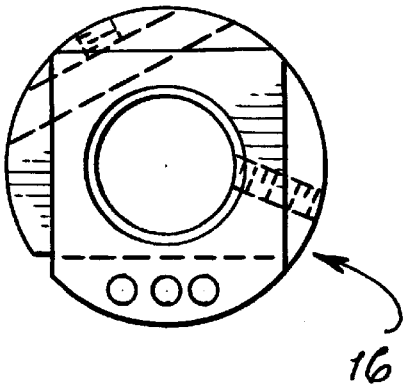
FIG. 8B is a left sided elevational view of the hub of FIG. 8A.
Figure 8D:
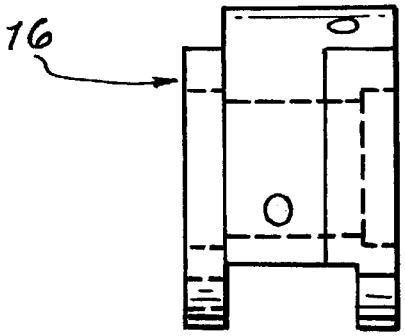
FIG. 8D is a front elevational view of the hub of FIG. 8A.
Figure 9:
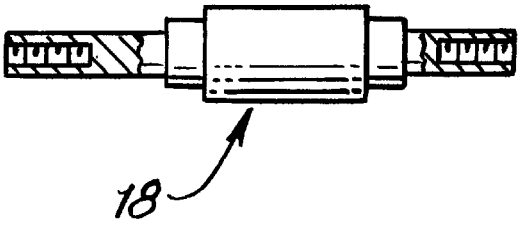
FIG. 9 is a top plan view of a hub-shaft of the present invention.
Figure 10A:
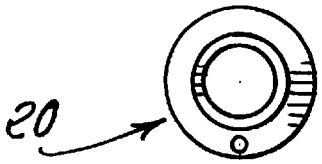
FIG. 10B is a side elevational view of the spring return wheel of FIG. 10A, the opposing side being identical thereto.
Figure 10B:
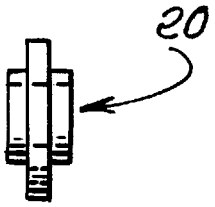
Figure 11A:
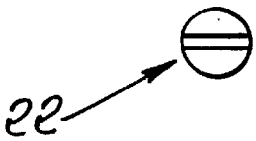
FIG. 11A is a top plan view of a shoulder screw for the spring return wheel 20.
Figure 11B:
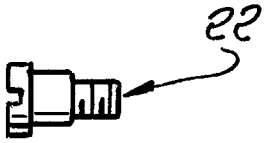
FIG. 11B is a side elevational view of the shoulder screw of FIG. 11A.
Figure 12A:
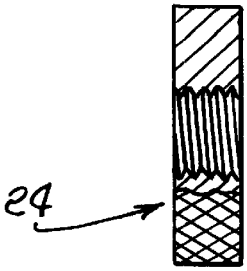
FIG. 12A is a side elevational view of a spring tension disk nut of the present invention, the opposite side being identical thereto.
Figure 12B:
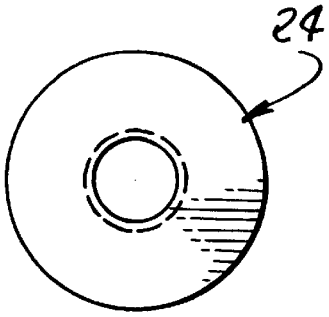
FIG. 12B is a top plan view of the spring tension disk nut of FIG. 12A, the bottom plan view being identical thereto.
Figure 13:
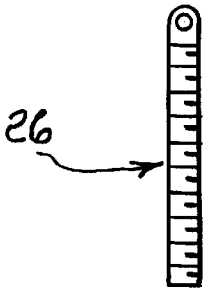
FIG. 13 is a side elevational view of a spring tension adjustment stem of the present invention.
Figure 14A:
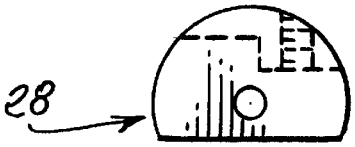
FIG. 14A is a side elevational view of a lever lock housing of the present invention.
Figure 14B:
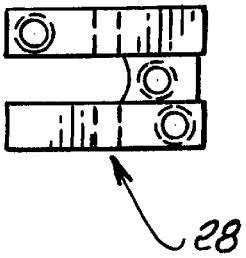
FIG. 14B is a bottom plan view of the lever lock housing of FIG. 14A.
Figure 15B:
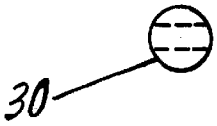
FIG. 15B is an end plan view of the lever lock lever of FIG. 15A.
Figure 15A:
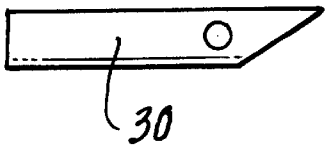
FIG. 15A is a side elevational view of a lever lock of the present invention.
Figure 16:
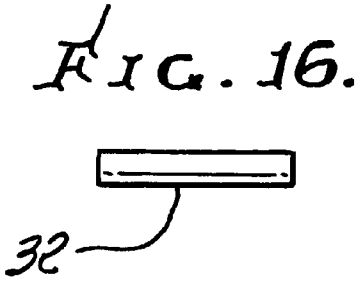
FIG. 16 is a side elevational view of a lever lock hinge pin of the present invention.
Figure 17:
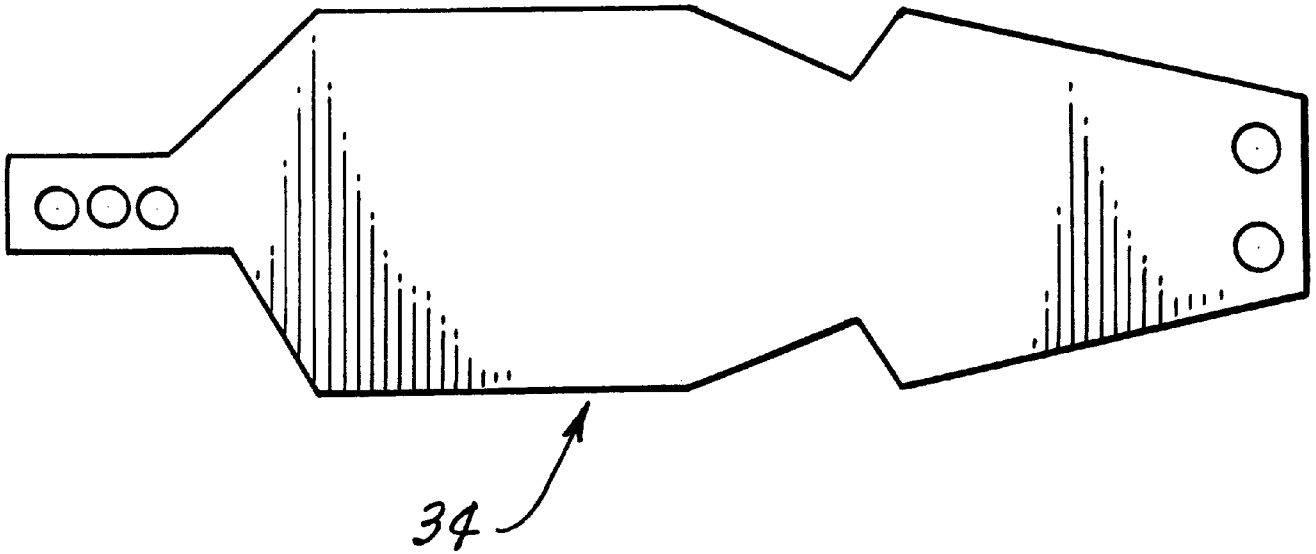
FIG. 17 is a top plan view of a pedal.
Figure 18A:
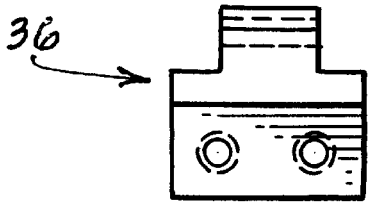
FIG. 18A is a plan view of a hinge part.
Figure 18B:
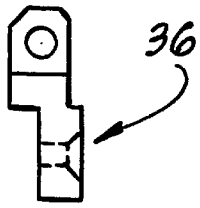
FIG. 18B is a side view of the FIG. 18A hinge part.
Figure 19A:
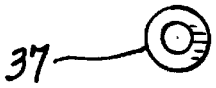
FIG. 19A is a plan view of a bearing.
Figure 19B:
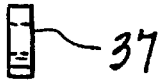
FIG. 19B is a side view of the FIG. 19A bearing.
Figure 20A:
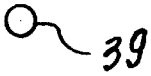
FIG. 20A is an end view of a hinge pin.
Figure 20B:
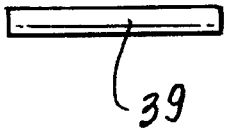
FIG. 20B is a side view of the FIG. 20A pin.
Figure 20C:
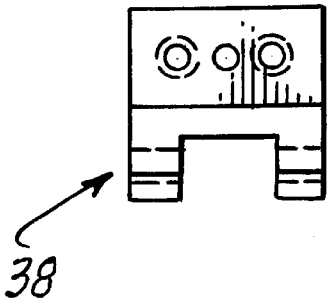
FIG. 20C is a plan view of a hinge part.
Figure 20D:
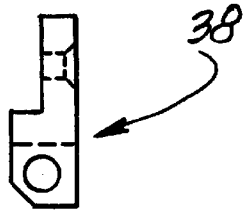
FIG. 20D is a side view of the FIG. 20D hinge part.
Figure 22:
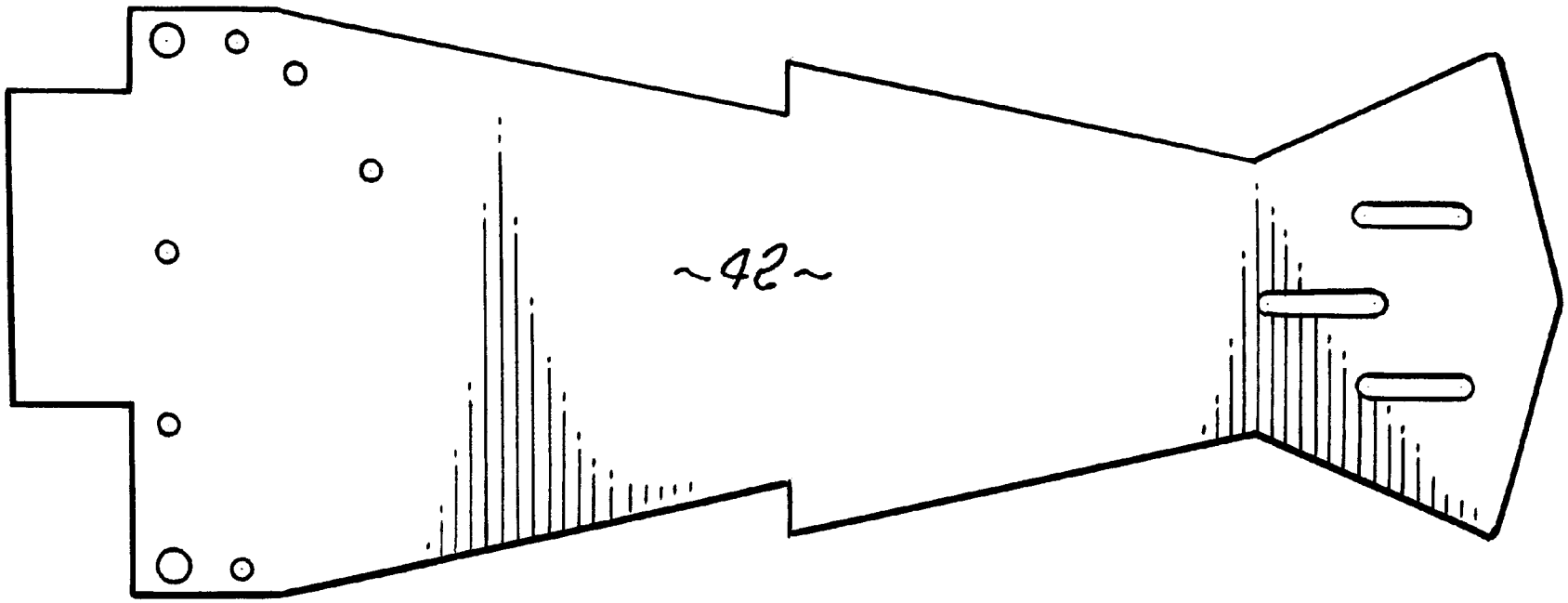
FIG. 22 is a top plan view of the base plate of the present invention.

In FIGS. 1.1A, 1.1B, 1.1C, and 1.2A, 1.2B, and 1.2C, various assembly states of one embodiment of the invention are shown, as referenced in the above "Brief Description of the Drawings ". Also described above for FIGS. 2A through 22, are detailed views of the individual parts or components of the one embodiment of the invention shown.

With the problems of the prior art in mind, the present inventor improved bass drum pedal design in a number of different aspects. In one embodiment of the invention, with reference to the below described FIGS. 1.1A through 22, the bass pedal unit includes a foot pedal or board 34 connected at one end by a flush hinge 36, 38 to base plate 42, with the other end of the foot pedal connected to one end of a narrow flexible drive belt 19. The drive belt 19 is typically a relatively thin standard nylon rope cord drive belt, or any suitable flexible drive belt. The belt 19 is routed around a pulley or hub 16, with the pulley or hub 16 being centrally mounted on a horizontal axle 18 that is generally parallel to the base plate 42.

The pulley or hub 16 is a multi-section device that includes internal bearings 17 having inner and outer raceways to permit the hub 16 to rotate about the shaft or axle 18 upon which the pulley or hub is mounted. In one embodiment of the invention, the shaft or axle 18 itself can be fixed, and in another preferred embodiment of the invention the axle 18 can itself also be mounted for rotation on bearings. The axle 18 is mounted between two upright support members, or pedestals, also referred to as towers 4 and 6. A rod 21 is connected to a pulley or hub 16 mechanism on the axle 18, with the other end of the rod 21 being connected to a drum beater pad 23. The rod defines a beater stem 21. The lower end of the belt 19 entrained over the pulley or hub 16 is connected to the free end of the pedal 34. A spring biased mechanism 7, 10, 20, 24, 26 having one end connected to the hub 16 and another end to a portion of one of the towers 6, keeps the pedal 34 in an elevated position at rest, with the drum beater pad or mallet 23 being in a position that is a predetermined distance away from the face of the associated bass drum. By depressing the foot pedal 34, the beater pad 23 is rotated to strike the drum with the maximum surface area of beater pad 23. A clamping mechanism 12, 28, 30 is attached to the front of the base plate 42 for permitting the bass pedal 34 to be secured to the frame of an associated bass drum.

The various embodiments of the present invention have advantages over many prior art drum pedals. These advantages are as follows:

1. The beater 23 contacts the drum head or skin at 90° to the face of the beater pad for maximum contact, whereas many prior art devices have the beater pad contact the drum head at an angle.

2. The center hub 16 provides all interconnection from belt 19 to the beater stem 21, eliminating more complicated designs of the prior art, providing better response in the dynamic range, and reducing mechanical noise, whereby the invention is virtually silent and free of friction during operation.

3. The horizontal shaft or axle 18 can be mounted between the upper ends of the towers via bearings, which permit the shaft or axle 18 to itself rotate. The centrally located hub 16 is mounted on bearings 35 on the shaft 18, whereby the hub 16 itself can rotate about the shaft 18. The hub 16 has the beater stem 21 secured to it, the other end of which is secured to beater 23. A strap 19 is wrapped around the hub 16 and secured at one end to the hub 16, with the other end of the strap 19 being secured to the pedal 34. The hub 16 is spring biased via spring 7 for at rest retention of the beater 23 in a predetermined position, and the pedal 34 in an upright or elevated position. When the pedal 34 is depressed by a drummer, the hub 16 typically rotates about the shaft 18 causing the beater 23 to rotate and to come into impact contact with the drum face or skin. If at times excess friction occurs in the bearings 35 between the hub and the shaft, the shaft itself will rotate about its bearings 37 within the tower, with the combination of the strap 19 and associated illustrated drive providing a very quiet and smooth operation.

4. The spring biasing of the hub 16 is provided by a spring 7 having one end connected to a rotatable spring wheel or element 20 secured to a bottom portion of the hub 16, with the other end of the spring 7 being connected to one end of a spring return adjustment bearing stem 26, with the latter having another end secured on a bearing stem 10 to the associated tower 6, thereby permitting it to rotate as necessary. The spring return wheel 20 attached to the hub 16 includes internal double bearings attached to hub 16 via a shoulder screw 22, for permitting rotation as necessary relative to the spring 7 and movement of the hub 16. A rotatable bearing in the tower 6 connected via spring return bearing stem 10 to the other end of the spring 7 provides for a smoother operation. Spring tension adjustment is provided by threaded part 26.

5. In another embodiment, a relatively thin and light foot board or pedal 34 is utilized that is substantially lighter than those provided by the prior art, thereby providing faster return of the beater pad 23 to its rest position, and requiring less effort to use the pedal 34 itself, thereby not tiring the drummer as quickly. A standard foot board or pedal can otherwise be utilized which is substantially thicker than the aforesaid light foot board or pedal embodiment.

6. A flush hinge 36, 38 design is used at the heel pad 40 at the bottom of the foot board 34, unlike the prior art which utilizes a typical door hinge type design.

FIGS. 23–30 illustrate further details of the invention shown in FIGS. 1–22, with corresponding elements bearing the same identifying numerals.

In the embodiment shown in FIGS. 23–33, a carrier structure 110 is shown to include a generally horizontal base plate or foot board 111 on which pedal 112 is carried to extend forwardly and upwardly. The pedal has pivoted support at its rearward end, as indicated at 112*a*. Such support may be provided by a roller bearing or bearings, as for example is disclosed in U.S. Pat. No. 5,627,332, incorporated herein by reference. Pin connected hinge parts 108 and 109 are connected with the foot board, and with a heel plate 109*a* on the foot board. Parts 109 and 109*a* may be shifted forwardly or rearwardly, when a retainer 200 is loosened and shifted in a slot 201 in the base plate 111. See FIG. 31. Other connections may be provided.

Figure 23:
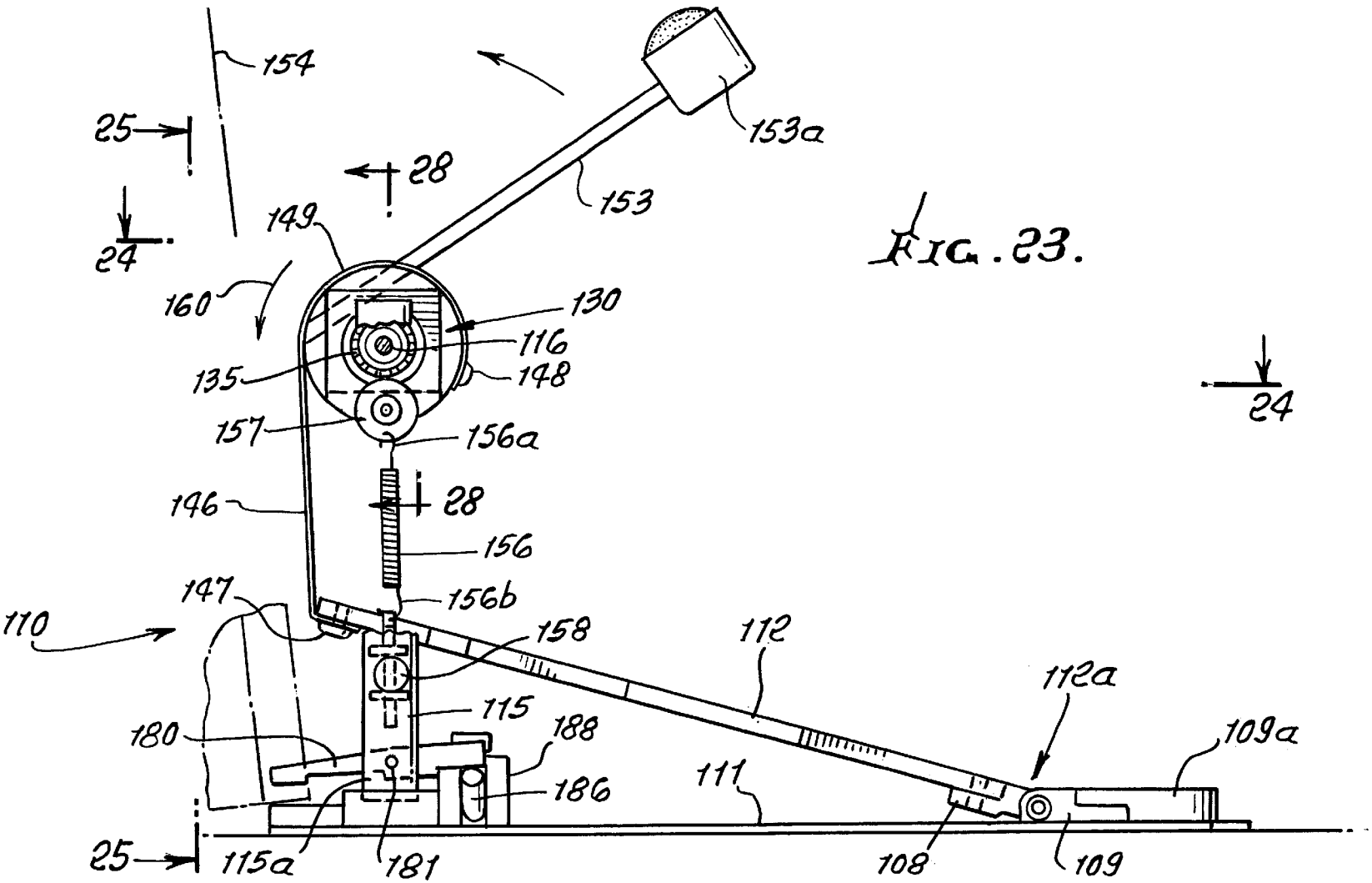
FIG. 23 is a side elevation of a similar form of the pedal unit as also seen in FIG. 1.1C.
Figure 24:
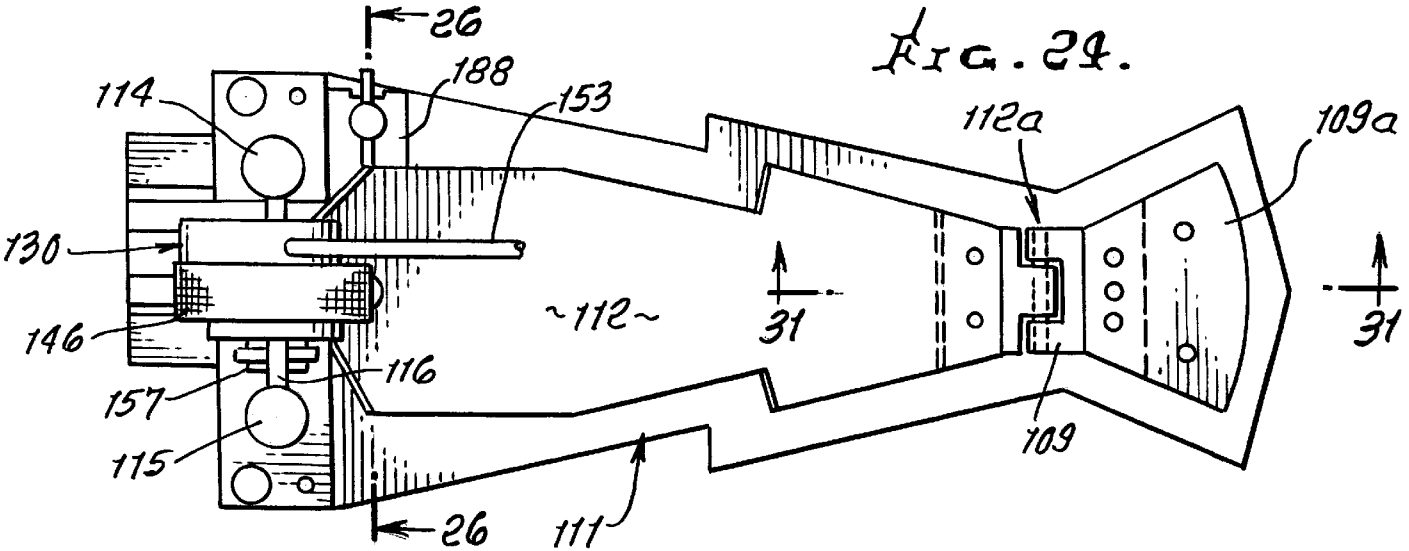
FIG. 24 is a plan view taken on lines 24—24 of FIG. 23.
Figure 25:
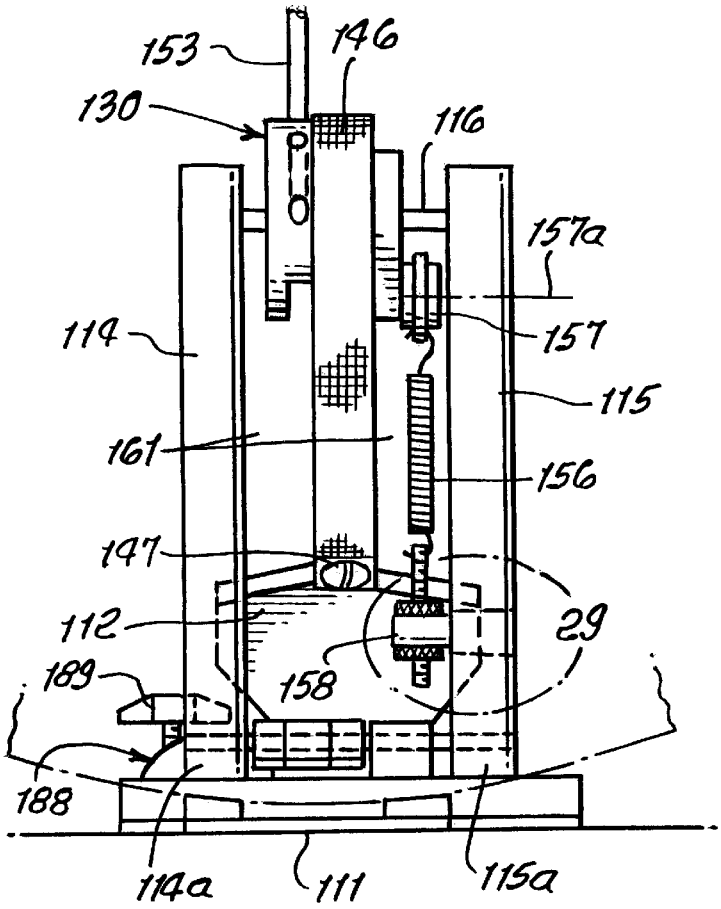
FIG. 25 is an elevation taken on lines 25—25 of FIG. 23.
Figure 28:
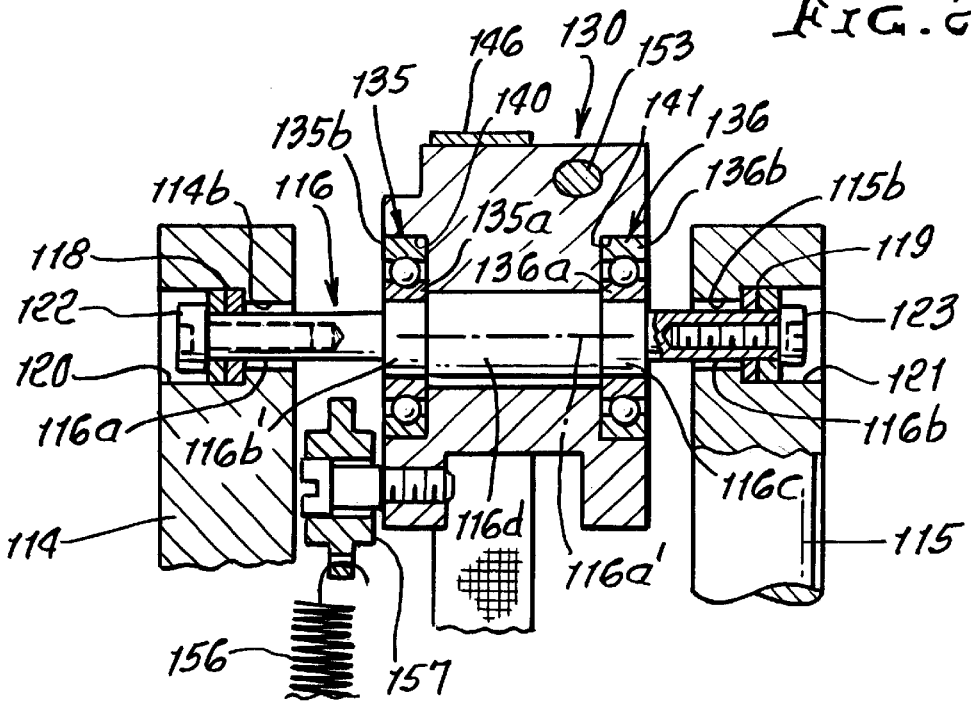
FIG. 28 is an enlarged section taken on lines 28—28 of FIG. 23.
Figure 30:
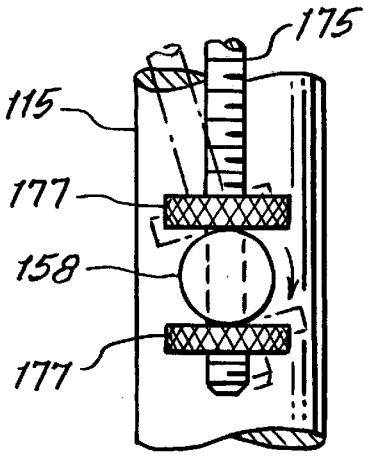
FIG. 30 is an elevation taken on lines 30—30 of FIG. 29.

First and second pedestals or towers 114 and 115 are carried by the base plate 111 and may typically have their lower ends 114*a* and 115*a* connected to the plate, as seen in FIGS. 23 and 25. Upper ends of the towers project freely upwardly. A shaft or shaft structure 116 is mounted to project laterally between the two towers, as shown in FIGS. 25 and 28. The towers have openings 114*b* and 115*b* in their upper ends portions to receive the ends 116*a* and 116*b* of the shaft. Those opposite ends may be carried by supports 118 and 119 received in counterbores 120 and 121 formed in the tower upper ends. Retainers 122 and 123 retain the shaft opposite ends to the supports, and may be removed axially endwise of the shaft, to allow rapid disassembly. The number and/or thicknesses of washer-like supports 118 and 119 may be varied, to allow axially endwise adjustment positioning of a hub 130 on the shaft, relative to the towers. The shaft is thereby held fixed relative to the towers; but, if desired, the shaft may be allowed to rotate relative to the towers. For that purpose, the supports 118 and 119 may represent bearings that allow the shaft to rotate about its axis 116*a*, as described above.

Hub 130 may rotate with the shaft 116, or may rotate on and independently of the shaft, about the shaft axis. The hub is carried by a central portion of the shaft, between the two towers. As shown, two roller bearings 135 and 136 are carried on the shaft and carry the hub for rotation. See bearing inner races 135*a* and 136*a* mounted on shaft portions 116*b* and 116*c*, and bearing outer races 135*b* and 136*b* retained in hub bores 140 and 141. Bearing balls are positioned between the two races. Accordingly, if the shaft ends are attached to the tower upper ends, the hub is rotatable relative to the towers and shaft; or if the shaft ends are rotatable relative to the tower upper ends, the hub is also rotatable relative to the towers and shaft. If the hub is attached to the central portion of the shaft, as for example at 116*d*, and if the shaft opposite ends are rotatable relative to the towers, as referred to above, the hub and shaft are rotatable together, relative to the two towers.

A hub rotating means is provided to act between the forward portion of the foot board 112, and the hub, and may comprise a flexible connector 146 connected at 147 to the foot board, and at 148 to a curved outer portion 149 of the hub. That portion 149 may extend cylindrically about the shaft axis, or may extend eccentrically relative to the axis, to effect variable rate of rotation of a hub supported beater or mallet 153*a* relative to a drum surface 154 to be struck.

Spring means or structure is provided for spring biasing the hub in the rest position of the foot board, seen in FIGS. 23 and 25. See spring 156, the upper end 156*a* of which is attached to an eccentric element 157 on the hub, and the lower end 156*b* of which attaches to a swivel 158. This maintains the beater 153*a* on shaft 153 a predetermined distance from the drum head 154 of an associated drum. Accordingly, upon depression of the foot board, its second end is rotated toward the base plate 111, to cause the belt 146 to rotate the hub in a direction (see arrow 160 in FIG. 1) for moving the beater into impact contact with the drum head.

Note in FIG. 25 that the eccentric element 157, the spring 156, and swivel or pivot 158 are all protectively located in the zone 161 between the towers or pedestals 114 and 115; and that the spring acts substantially directly upon the hub. Swiveling of the lower end of the spring, as provided by 158, enhances the very low friction rotary motion or movement of the hub 130, allowing faster response of the beater to up and down movement of the foot board 112. Element 157 may comprise a rotor or wheel that is rotatable about a lateral axis 157*a*, eccentric to the hub axis of rotation.

Figure 29:
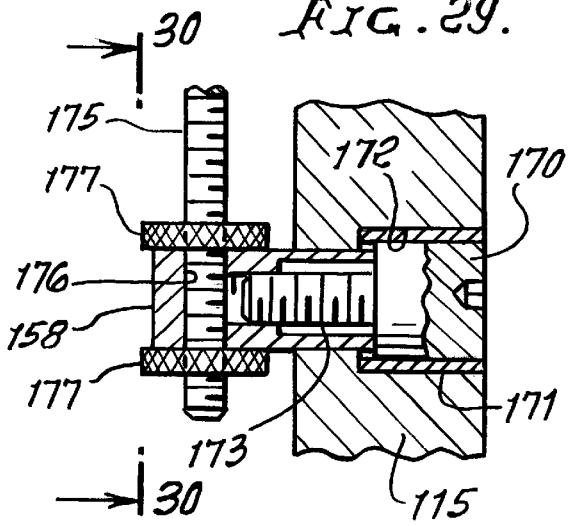
FIG. 29 is an enlarged section also indicated in FIG. 25.
Figure 31:
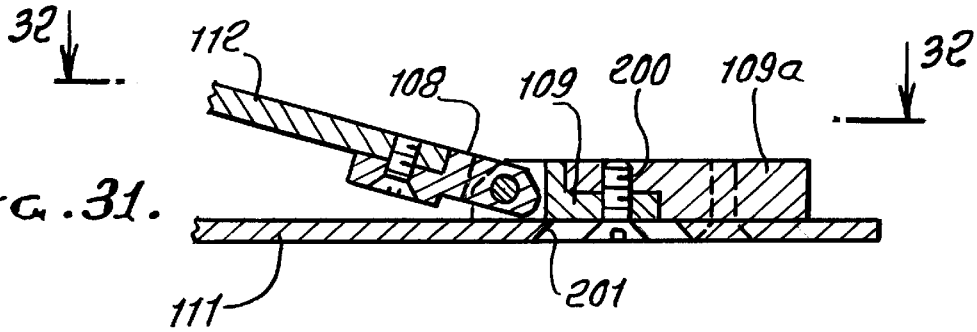
FIG. 31 is an enlarged elevation showing foot-board hinging.
Figure 32:
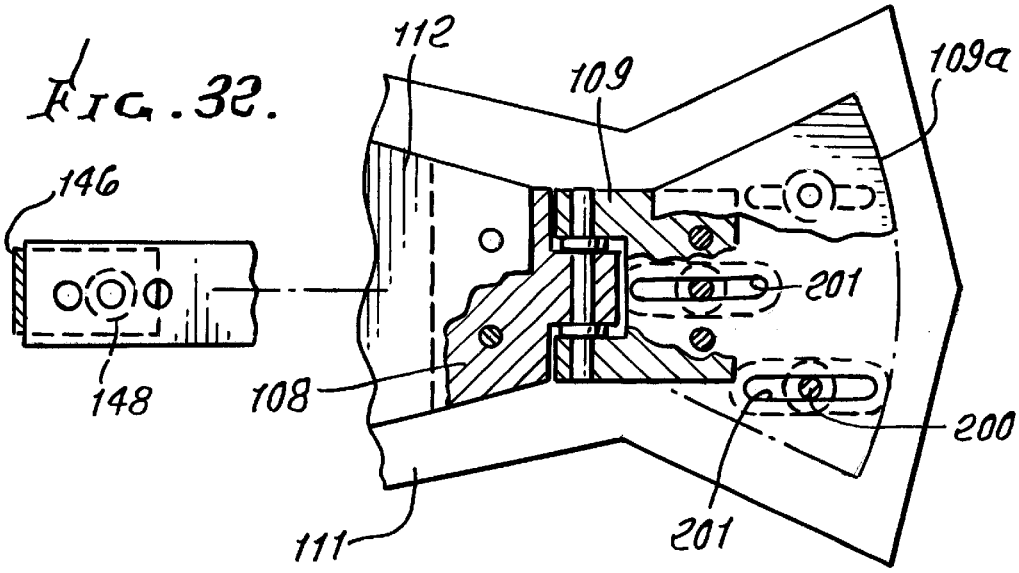
FIG. 32 is a plan view taken on lines 32—32 of FIG. 31.

FIG. 29 shows swivel 158 carried by a rotor 170 that pivots within a bearing 171 received in a bore 172 in tower 115. A threaded fastener 173 attaches 170 to 158, as shown. An upright fastener 175 is attached to the lower end of the spring, and projects within an opening 176 in the swivel. Adjustable nuts 177 are threaded to the fastener 175, and may be tightened against the swivel, as shown. Adjustment of the nut and the fastener 175, relative to swivel 158, permits vertical positioning of 175, and consequent adjustment of spring tension in spring 156, as it resists down-pivoting of the foot board 112.

Figure 27:
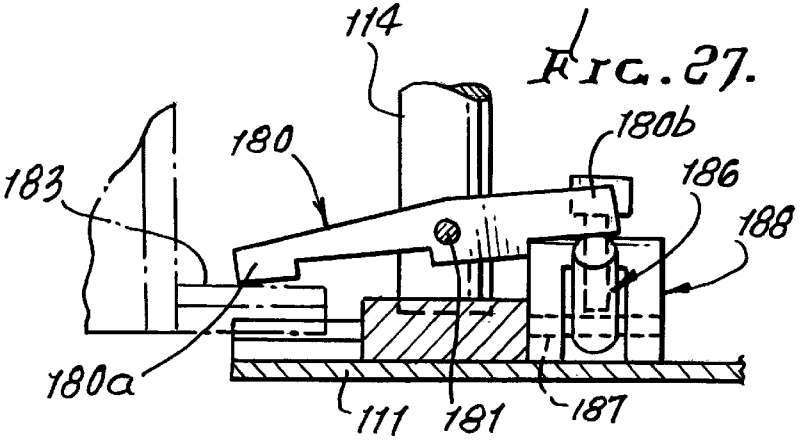
FIG. 27 is a section taken on lines 27—27 of FIG. 26.
Figure 26:
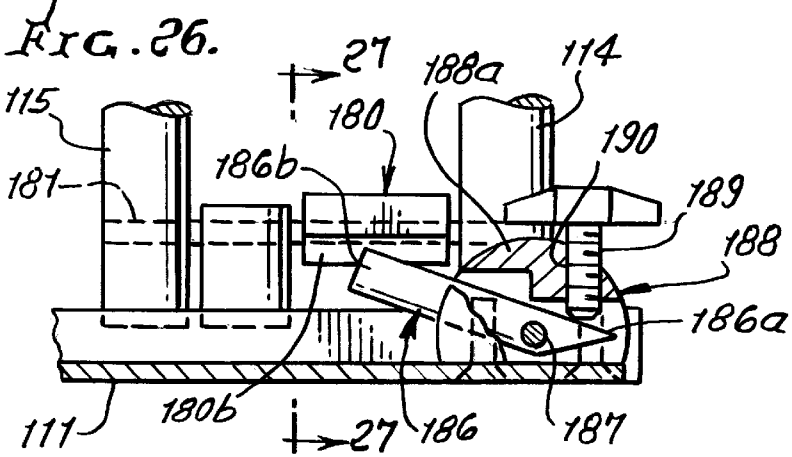
FIG. 26 is an enlarged elevation taken on lines 26—26 of FIG. 24.

FIG. 27 shows a clamp lever 180 pivotably attached at 181 to pedestal or tower 114. The forward end 180*a* of the lever clamps down onto a drum rim 183, when the rearward end 180*b* of the clamp arm is elevated, as by a lifter bar 186. The latter extends transversely (see FIG. 26), and is pivoted at 187 to structure 188 associated with the base plate. An adjustable screw 189 may be rotated to press down on the end 186*a* of the lifter bar, elevating end 186*b* of that bar, to in turn elevate the rod 180*b* of the clamp arm. Screw 189 is threadably attached at 190 to structure 188*a*. See FIGS. 26 and 27.

Figure 33:
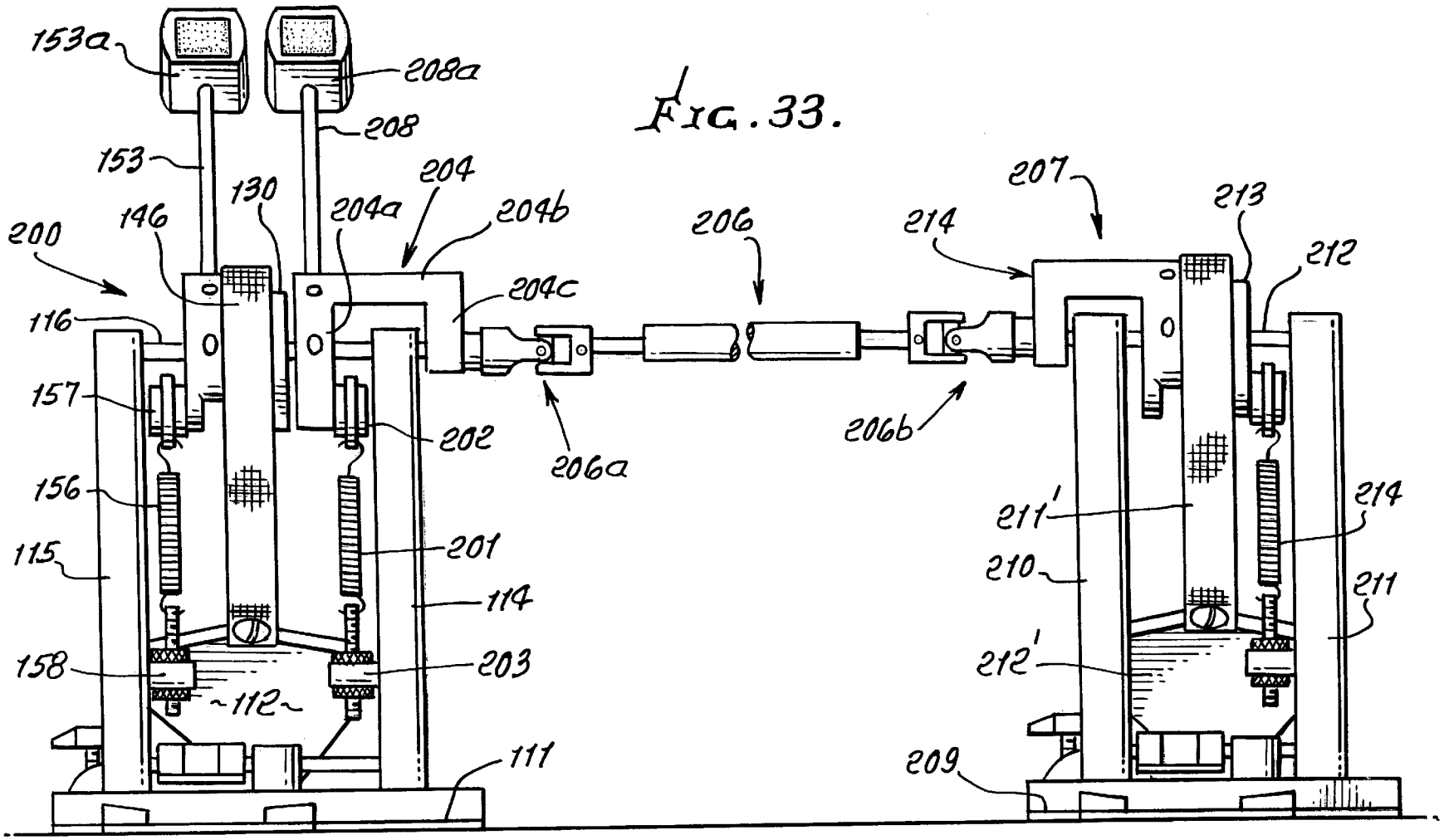
FIG. 33 is a front elevation of a modified form of the invention.

FIG. 33 shows structure 200 generally the same as that described in FIGS. 23–32, above. Added to or combined with that structure are the following:

i) a second tension spring 201, like spring 156, and connected between a second eccentric element 202 on hub 130, at its opposite side, and a second horizontally rotatable swivel 203 rotatably carried by the tower or pedestal 114;

ii) a driver arm 204 having an upright section 204*a* attached to element 202, a horizontal section 204*b*, and an upright section 204*c* extending at the outer side of pedestal 114;

iii) a linkage 206 rotatably driving by driver arm 204;

iv) a second drum beater unit 207 similar to unit 200, driving the linkage 206, for in turn driving beater stem 208 and mallet 208*a* to beat or impact the drum head. Unit 207 includes a base plate 209; two upright towers or pedestals 210 and 211; an axle or shaft 212; a hub 213 rotatably mounted on the shaft; and a U-shaped connector 214 (like 204) connecting the rightward end of the linkage 206 to the hub 213. Accordingly, as structure 207 is operated, the linkage 206 causes rotation of hub 213, and rotation of 208 and 208*a*. A foot board 210 is also provided, like board 112, and a belt 211 connects that board to the hub 213 in the same manner as described in FIG. 23. Also, a tension spring 214 operates to resist down pivoting of the board 210, in the same manner as spring 156. Either or both of the foot boards may be operated to cause the beater and mallets to rotate and impact a common drum head.

Typically, the second hub is attached to the second shaft, so that rotation of the second hub rotates the linkage 206. Universal joint couplings are provided in the linkage 206 at 206*a* and 206*b*.

FIGS. 2A, 3A, 3B, 3C, 3.1A, 3.1B show lower end portions of the towers or pedestals 4 and 6 as having capability for movement or adjustment relative to the base plate 42. For example, the tower lower ends having individually adjustable connection to the support. Threads shown at said lower end portions of the towers enable adjustable threaded connection to the support, as by suitable fasteners. FIG. 2A shows provision for multiple such connections, i.e. the towers may be connected to the support to vary the lateral spacing between the towers. Accordingly, the pedestals have adjustable lateral spacings therebetween, and the pedestal lower end portions have multiple selectable lateral connection to the support, and the support may have connection structure providing for such multiple lateral connections to the support. Example of such connections are shown at 42*a*, 42*b* and 42*c*, which are threaded connections. Suitable threaded fasteners may connect 42*a* and 42*b* to lower threaded ends of the two pedestals, or may connect 42*a* and 42*b* to lower ends of the two pedestals, thereby to vary the lateral spacing between the pedestals. Such threading is indicated at 4*a* ad 6*a*.

Referring to FIGS. 25, 28, 29 and 30, a "rotating pendulum" structure is provided. It includes spring return apparatus for a drum pedal unit that comprises:

a) support structure b) a drummer's foot actuated foot board, the board having a rear portion supported by the support structure, c) the support structure including at least one upright pedestal, and preferably two pedestals, d) rotary structure carried by the pedestal or pedestals, and including a drum beater, said rotary structure defining a first axis of rotation. The spring return apparatus comprises:

e) a spring unit having opposite ends, f) one of the opposite ends operatively connected to the rotary structure in eccentric relation to the first axis, so that the drum beater is urged toward a rest position, g) and the other of those opposite ends pivotally and operatively connected to the support structure, so that said other end pivots as said one end rotates relative to said axis and relative to the first axis and also relative to said rest position.

The described apparatus typically includes a pivot carried by said pedestal or pedestals to rotate about a second axis parallel to the first axis, the spring other end connected to that pivot. The rotary structure also typically includes a rotor that is operatively connected to a forward portion of the foot board, so that the rotor rotates the beater as the foot board forward portion moves downwardly; the spring one end being operatively connected to the rotor in offset relation to the first axis, whereby said other end of the spring pivots as said one end of the spring is displaced as the rotor rotates, and as the spring is variably tensioned.

Further, the said pedal unit typically includes a flexible connection between the rotary structure and a forward portion of said foot board, said spring sidewardly spaced from that flexible connection.

I claim:

1. A base drum pedal comprising in combination:

a) a base support, b) a foot board having first and second ends, c) a hinge connected between said base plate and said first end of said foot board for permitting rotation thereof, d) first and second upstanding towers each mounted at one end, respectively, to said base support, with their other respective ends being free, e) a shaft mounted for axial rotation between the opposing upper portions of said first an second towers, f) a hub mounted for axial rotation on a central portion of said shaft, whereby said hub is rotatable independently of said shaft, and whereby said shaft rotates with said hub upon frictional engagement of the hub with the shaft, g) rotating means connected between the second end of said foot board and an outer portion of said hub for causing said hub to rotate away from said foot board upon depression of said foot board, h) a beater stem having a first end secured to an outer portion of said hub, and a second end, i) a beater secured to said second end of said beater stem, j) spring means for spring biasing said hub in the rest position of said bass drum pedal, for retaining the second end of said foot board in an elevated position relative to said base support, and said beater a predetermined distance away from a drum head of an associated drum, whereby upon depression of said foot board said second end thereof is rotated toward said base support causing said rotating means to rotate said hub in a direction for moving said beater into contact with the drum head of the associated drum.

2. The combination of claim 1, including said second tower mounted at one end of said support, and spaced from said first tower, said spring located between said first and second towers.

3. The combination of claim 1, wherein said spring means is a tension spring having one end thereof pivotally connected to said hub.

4. The combination of claim 3 wherein the tension spring has an opposite end, and there is a pivotal connection between that opposite end and one of said first and second towers.

5. The combination of claim 3 wherein there is a pivotal connection between the hub and the tower.

6. The combination of claim 5 wherein said rotating means defines an upright plane, said spring pivotal connection located at one side of said plane, and said beater stem located at the opposite side of said plane.

7. The combination of claim 1 wherein said rotating means is one of the following:

a) a belt or chain having one end portion wrapping partially about said hub, b) a non-flexible connector.

8. The combination of claim 1 including a ball bearing unit mounting on the hub for rotation on the axle.

9. The combination of claim 1 wherein the shaft is an axle mounted for rotation relative to the tower.

10. A base drum pedal comprising in combination:

a) a support, b) a foot board having first and second ends, c) a hinge connected between said support and said first end of said foot board for permitting rotation thereof, d) at least one upstanding tower mounted at one end, to said support, with its other end being free, e) a shaft projecting laterally from an upper portion of said tower, f) a hub mounted for axial rotation on a portion of said shaft, whereby said hub is rotatable independently of said shaft, g) a flexible connector connected between the second end of said foot board and an outer portion of said hub for causing said hub to rotate upon depression of said foot board, h) a beater stem having a first end secured to an outer portion of said hub, and a second end, i) a beater secured to said second end of said beater stem, j) a spring biasing said hub in a rest position of said bass drum pedal, for retaining the second end of said foot board in an elevated position relative to said support, and said beater a predetermined distance away from a drum head of an associated drum, whereby upon depression of said foot board said second end thereto is pivoted causing said flexible connector to rotate said hub in a direction for moving said beater into contact with the drum head of the associated drum, k) and a horizontal rotatable swivel rotatably carried by the tower, the spring connected to said swivel.

11. The combination of claim 10 including a second tower mounted at one end of said support, and spaced from said one tower, said spring located betweens said towers.

12. The combination of claim 10 wherein said spring is a tension spring having one end thereof pivotally connected to said hub.

13. The combination of claim 12 wherein the spring has an opposite end, and there is a pivotal connection between that opposite end and one of the towers.

14. The combination of claim 10 wherein said flexible connector is a belt having one end portion wrapping partially about said hub.

15. The combination of claim 10 including a ball bearing unit mounting the hub for rotation on the axle.

16. The combination of claim 10 wherein the shaft is an axle mounted for rotation relative to the tower.

17. The combination of claim 12 wherein there is a pivotal connection between the hub and the tower.

18. A base drum pedal comprising in combination:

a) a support, b) a foot board having first and second ends, c) a hinge connected between said support and said first end of said foot board for permitting rotation thereof, d) at least one rod-like tower mounted at one end, to said support, with its other end being free, e) a shaft projecting laterally from an upper portion of said tower, f) a spool-like hub mounted for axial rotation on a portion of said shaft, whereby said hub can rotate independently of said shaft, g) a flexible connector connected between the second end of said foot board and an outer portion of said hub for causing said hub to rotate relative to said tower upon depression of said foot board, h) a beater stem having a first end secured to an outer portion of said hub, and a second end, i) a beater secured to said second end of said beater stem, j) a spring biasing said hub in a rest position of said bass drum pedal, for retaining the second end of said foot board in an elevated position relative to said support, and said beater a predetermined distance away from a drum head of an associated drum, whereby upon depression of said foot board said second end thereof is pivoted causing said flexible connector to rotate said hub in a direction for moving said beater into contact with the drum head of the associated drum, k) said spring being a tension spring having one end thereof pivotally connected to said hub, l) there being a pivotal connection between the hub and the tower, m) and wherein said flexible connector defines an upright plane, said spring pivotal connection located at one side of said plane, and said beater stem located at the opposite side of said plane.

19. The combination of claim 18 wherein said flexible beater first end and said spring pivotal connection are located at substantially diametrically opposite sides of an axis defined by said shaft.

20. A base drum pedal comprising in combination:

a) a support, b) a foot board having first and second ends, c) a hinge connected between said support and said first end of said foot board for permitting rotation thereof, d) at least one rod-like tower mounted at one end, to said support, with its other end being free, e) a shaft projecting laterally from an upper portion of said tower, f) a spool-like hub mounted for axial rotation on a portion of said shaft, whereby said hub can rotate independently of said shaft, g) a flexible connector connected between the second end of said foot board and an outer portion of said hub for causing said hub to rotate relative to said tower upon depression of said foot board, h) a beater stem having a first end secured to an outer portion of said hub, and a second end, i) a beater secured to said second end of said beater stem, j) a spring biasing said hub in a reset position of said bass drum pedal, for retaining the second end of said foot board in an elevated position relative to said support, and said beater a predetermined distance away form a drum head of an associated drum, whereby upon depression of said foot board said second end thereof is pivoted causing said flexible connector to rotate said hub in a direction for moving said beater into contact with the drum head of the associated drum, k) a second support l) a second foot board having first and second ends, m) a hinge connected between said second support and said first end of said second foot board for permitting rotation thereof, n) at least one rod-like second tower mounted at one end, to said second support, with its other end being free, o) a second shaft projecting laterally from an upper portion of said second tower, p) a second spool-like hub mounted for axial rotation on a portion of said second shaft, whereby said second hub is rotatable independently of said second shaft, q) a second flexible connector connected between the second end of said foot board and an outer portion of said second hub for causing said second hub to rotate relative to said second tower upon depression of said second foot board, r) a second beater stem rotatably driven in response to rotation of said second hub, s) and a beater secured to said second end of said beater stem.

21. The combination of claim 20 including a spring biasing said second hub in a rest position of said second beater, for retaining the second end of said second foot board in an elevation position relative to said second support, and said second beater a predetermined distance away from a drum head whereby upon depression of said second foot board said second end thereof is pivoted causing said second flexible connector to rotate said second hub in a direction for moving said second beater into contact with the drum head.

22. The combination of claim 21 wherein said second spring has a swivel connection to said second tower.

23. The combination of claim 20 including a rotary linkage for transmitting drive to the second beater stem for the second hub.

24. The combination of claim 23 wherein said linkage includes at least one arm extending relatively over an end portion of one of said towers.

25. A bass drum pedal, comprising, in combination a) a support, b) a foot board supported for pivoting relative to the support, c) at least one pedestal extending upwardly relative to the support, d) a shaft carried to project laterally relative to the pedestal, above the levels of the support and foot board, e) a hub carried to rotate about a lateral axis defined by the shaft, f) a flexible connector connected to rotate the hub when the foot board is pivoted downwardly, g) a drum beater carried by the hub to rotate the beater, h) a spacing biasing the hub to resist hub rotation in response to said downward pivoting of the foot board, i) and a horizontally rotatable swivel rotatably carried by said at least one pedestal, the spring connected to said swivel.

26. The combination of claim 25 wherein the spring is a tension spring having one end thereof operatively and pivotally connected to the hub.

27. The combination of claim 25 wherein the spring is a tension spring having an end portion thereof pivotally connected to said pedestal.

28. A drum pedal unit comprising, in combination:

a) a support, b) a drummer's foot activated foot board above the support, c) two upright pedestals associated with the support, d) said pedestals having lower end portions that are adjustable relative to the support, e) said pedestals having upper end portions, and there being rotary structure carried by the pedestal upper end portions, there also being a drum beater rotatable with said structure, to beat a drum, f) and connector structure operatively connected with said foot board and said rotary structure to rotate said structure in response to drummer's actuation of the foot board, g) and a tension spring biasing said rotary structure and having swivel connection to a pedestal at a lower side of that pedestal.

29. The combination of claim 28 wherein said pedestal lower end portions have individually adjustable connection to the support.

30. The combination of claim 28 wherein pedestals have adjustable lateral spacing therebetween.

31. The combination of claim 30 wherein the pedestal lower end portions have multiple selectable lateral connections to the support.

32. The combination of claim 31 wherein the support has connection structure providing for said multiple selectable lateral connections to the support.

33. The combination of claim 32 wherein said connection structure is threaded.

34. Spring return apparatus for a drum pedal unit that comprises a) a support structure b) a drummer's foot actuated foot board, said board having a rear portion supported by the support structure, c) the support structure including at least one upright pedestal, d) rotary structure carried by said at least one pedestal, and including a drum beater, said rotary structure defining a first axis of rotation, said apparatus comprising:

e) a spring unit having opposite ends, f) one of said opposite ends operatively connected to said rotary structure in eccentric relation to said axis, so that the drum beater is urged toward a rest position, g) there being a horizontally rotatable swivel rotatably carried by the pedestal, the other of said spring unit opposite ends operatively connected to said swivel, so that said spring unit other end pivots as said one end rotates relative to said axis and relative to said rest position.

35. The apparatus of claim 34 including a pivot carried by said pedestal to rotate about a second axis parallel to said first axis, said spring other end connected to said pivot.

36. The apparatus of claim 34 wherein said rotary structure includes a rotor that is operatively connected to a forward portion of the foot board, so that the rotor rotates the beater as the foot board forward portion moves downwardly, said spring one end operatively connected to the rotor in offset relation to the first axis, whereby said other end of the spring pivots as said one end of the spring is displaced as the rotor rotates, and as the spring is variably tensioned.

37. The apparatus of claim 36 including a pivot carried by said pedestal to rotate about a second axis parallel to said first axis, said spring other end connected to said pivot.

38. The apparatus of claim 34 wherein said pedal unit includes a flexible connection between said rotary structure and a forward portion of said footboard, said spring sidewardly spaced from said flexible connection.

39. The apparatus of claim 37 wherein said pedal unit includes a flexible connection between said rotary structure and a forward portion of said footboard, said spring sidewardly spaced from said flexible connection.

40. The apparatus of claim 34 wherein said rotary structure includes a shaft carrying said drum beater, said one of said opposite ends operatively connected to said shaft.

41. The apparatus of claim 34 wherein said rotary structure includes a cam associated with the drum beater, said one of said opposite ends operatively connected to said cam.

42. Spring return apparatus for a drum pedal unit that comprises:

a) support structure, b) a drummer's foot actuated foot board, said board having a rear portion supported by the support structure, c) the support structure including at least one upright pedestal, d) rotary structure carried by said at least one pedestal, and including a drum beater, said rotary structure defining a first axis of rotation, said rotary structure including a cam that is rotatable independently of a supporting shaft, said apparatus comprising:

e) a spring unit having opposite ends, f) one of said opposite ends operatively connected to said cam in eccentric relation to said axis, so that the drum beater is urged toward a rest position, g) and a horizontally rotatable swivel rotatably carried by said support structure, the other of said spring opposite ends connected to said swivel.

43. A base drum pedal comprising in combination:

a) a base support, b) a foot board having first and second ends, c) a hinge connected between said base plate and said first end of said foot board for permitting rotation thereof, d) at least one upstanding tower mounted at one end to said base support, with its opposite end being free, e) a shaft mounted by the tower for axial rotation, f) a hub mounted for axial rotation on a central portion of said shaft, whereby said hub is rotatable independently of said shaft, and whereby said shaft rotates with said hub upon frictional engagement of the hub with the shaft, g) rotating means connected between the second end of said foot board and an outer portion of said hub for causing said hub to rotate away from said foot board upon depression of said foot board, h) a beater stem having a first end secured to an outer portion of said hub, and a second end, i) a beater secured to said second end of said beater stem, j) spring means for spring biasing said hub in the rest position of said bass drum pedal, for retaining the second end of said foot board in an elevated position relative to said base support, and said beater a predetermined distance away from a drum head of an associated drum, whereby upon depression of said foot board said second end thereof is rotated toward said base support causing said rotating means to rotate said hub in a direction for moving said beater into contact with the drum head of the associated drum.

* * * * *